United States Patent [19]

Glazer

[11] Patent Number: 4,932,544

[45] Date of Patent: Jun. 12, 1990

[54] BOTTLE HOLDER

[76] Inventor: Gdalia Glazer, Jabotinsky St. 66/10, Rishon L'Zion, Israel

[21] Appl. No.: 389,937

[22] Filed: Aug. 7, 1989

Related U.S. Application Data

[63] Continuation-in-part of Ser. No. 279,605, Dec. 5, 1988, Pat. No. 4,901,874.

[30] Foreign Application Priority Data

Nov. 30, 1988 [IL] Israel ..... 88537

[51] Int. Cl.[5] ..... B65D 39/16

[52] U.S. Cl. ..... 215/226; 215/235; 215/239; 222/474; 222/475.1; 222/475; 81/3.44; 81/3.42; 81/3.09

[58] Field of Search ..... 215/226, 235, 244, 228, 215/239, 303; 220/85 SP; 222/469, 470, 472, 473, 474, 475, 475.1; 81/3.07, 3.09, 3.33, 3.29, 3.41, 3.42, 3.44

[56] References Cited

U.S. PATENT DOCUMENTS

| | | | |
|---|---|---|---|
| 2,234,508 | 3/1941 | Truesdale | 215/226 X |
| 3,384,275 | 5/1968 | Simms | 222/474 |
| 3,799,408 | 3/1974 | Palmer | 222/474 |
| 4,305,515 | 12/1981 | Tontarelli | 215/244 |
| 4,768,403 | 9/1988 | Bar-Noy | 81/3.44 X |
| 4,805,790 | 2/1989 | Leonetti et al. | 215/235 |

FOREIGN PATENT DOCUMENTS

| | | | |
|---|---|---|---|
| 0657741 | 4/1965 | Belgium | 215/226 |
| 0479802 | 5/1916 | France | 215/239 |
| 2272024 | 12/1975 | France | 81/3.42 |
| 513368 | 2/1955 | Italy | 215/239 |
| 1265137 | 10/1986 | U.S.S.R. | 81/3.09 |
| 0548243 | 10/1942 | United Kingdom | 215/244 |
| 0704202 | 2/1954 | United Kingdom | 81/3.09 |
| 1529141 | 10/1978 | United Kingdom | 222/475.1 |

*Primary Examiner*—Stephen Marcus
*Assistant Examiner*—Christine A. Peterson
*Attorney, Agent, or Firm*—Benjamin J. Barish

[57] ABSTRACT

A bottle holder comprises a handle manually graspable by a user, a cap remover carried by the handle for receiving, gripping and removing the cap of the bottle, an attachment member fixed to the handle, open at one end, and having internal threads at the opposite end for threading onto the external threads of the bottle neck, a closure pivotally mounted to the attachment member either to a closed position closing its open end or to an open position, and an operator carried by the handle and mechanically coupled to the closure to enable the operator, when operated by the user, to move the closure to either its open position or to its closed position with respect to the open end of the attachment member.

17 Claims, 3 Drawing Sheets

FIG 1
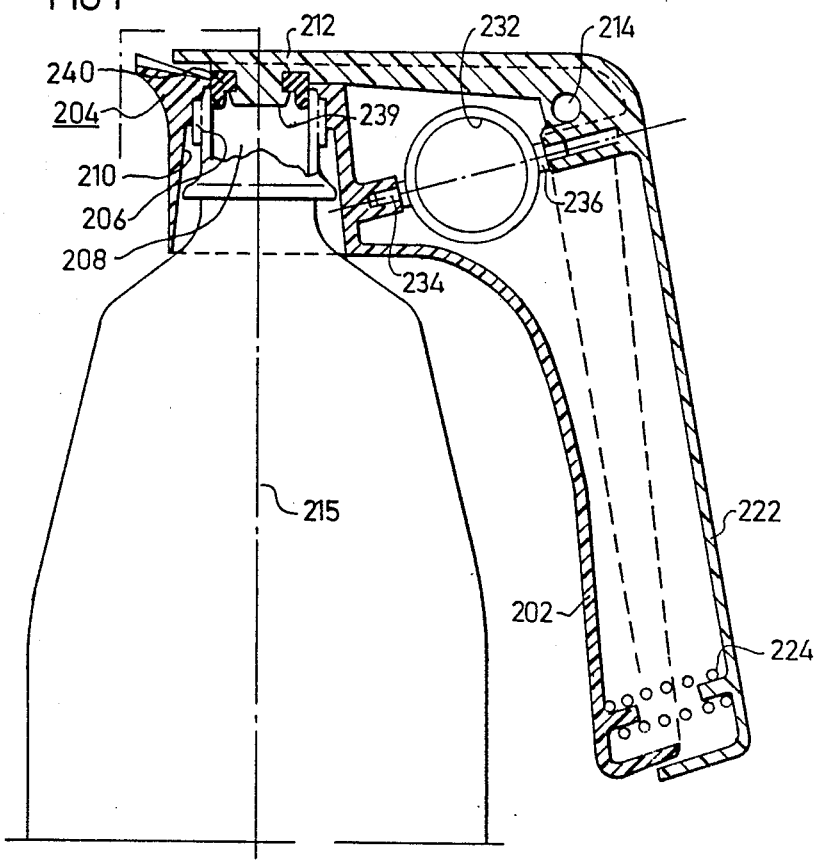
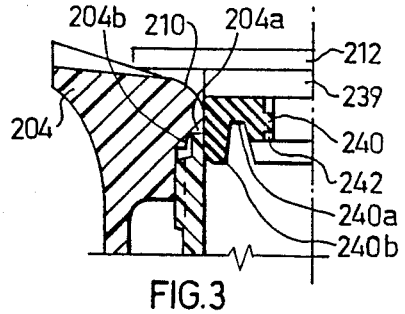
FIG.3
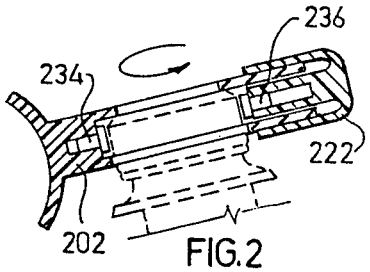
FIG.2
FIG.4
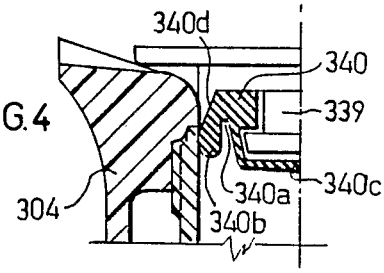

FIG. 6
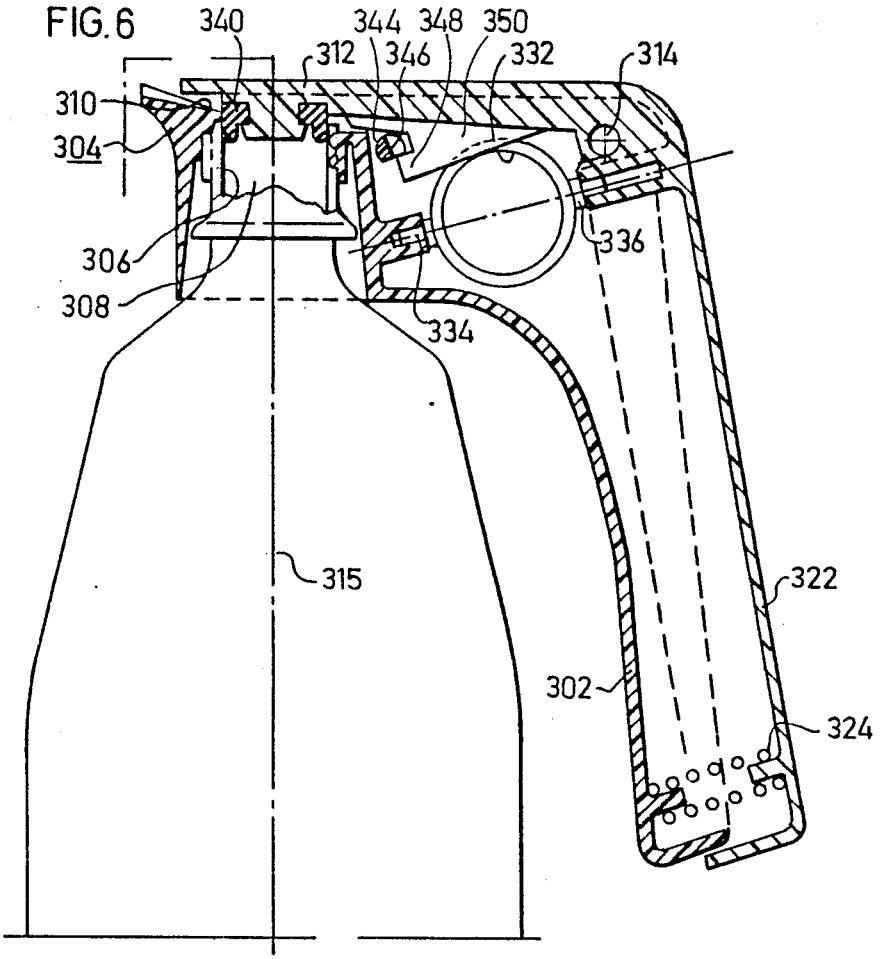
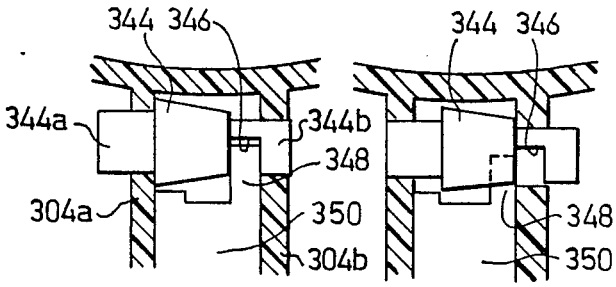
FIG. 7 FIG. 8

BOTTLE HOLDER

RELATED APPLICATION

The present application is a continuation-in-part of my patent application Ser. No. 07/279,605, filed Dec. 5, 1988, now U.S. Pat. No. 4,901,874, issued Feb. 20, 1990.

BACKGROUND OF THE INVENTION

The present invention relates to a bottle holder for use with conventional bottles, particularly plastic bottles, filled with carbonated beverages or other liquids.

Plastic bottles are increasingly being used for beverages and other liquids. In order to dispense the contents of the bottle, the user must grip the bottle, remove the cap, and then dispense its contents. This usually requires the use of both hands and is somewhat awkward, particularly with the larger size bottles which can be difficult to hold. Moreover, the normal bottle cap is frequently difficult for the user to remove, and to be reapplied with a good seal.

A number of arrangements have previously been proposed, as illustrated for example in U.S. Pat. Nos. 2,046,804, 2,447,146 and 3,185,332, to facilitate the removal of the normal bottle cap and to recap it, but such arrangements do not include any means for conveniently holding the bottle when dispensing its contents. Other arrangements have been proposed, as illustrated for example in U.S. Pat. No. 3,847,311, for holding a container in order to dispense its contents, but such arrangements are not designed particularly for bottles, and/or do not include means for removing the bottle caps.

An object of the present invention is provide a bottle holder having advantages in the above respects.

BRIEF SUMMARY OF THE INVENTION

According to the present invention, there is provided a bottle holder for a bottle having a neck formed with external threads for receiving a cap, the bottle holder comprising: a handle manually graspable by a user; an attachment member fixed to one end of the handle, the attachment member having internal threads at one end for threading into the external threads of the neck of the bottle and being open at the opposite end; a closure movably mounted to the attachment member either to a closed position closing the open end of the attachment member, or to an open position with respect thereto; an operator to the handle; the operator being fixed to the closure on one side of the pivotal mounting of the operator to the handle to enable the operator, when squeezed towards the handle, on the side opposite to the pivotal mounting, to pivot the closure to either its open position or to its closed position with respect to the open end of the attachment member; the closure including a stem carrying a sealing ring receivable within the neck of the bottle in the closed position of the closure; and spring means interposed between the handle and operator and normally urging the operator to the closed position of the closure.

The bottle holder further includes a cap remover having a gripping surface formed at an intermediate location on the handle and a gripping surface formed at a corresponding location on the operator, the gripping surfaces being located to engage and grip the opposite sides of the cap, when the operator is operated by the user, and thereby to facilitate removal of the cap by rotating the handle about the axis of the bottle neck. As more particularly described below, the gripping surfaces in the handle and operator are defined by pins fixed to the handle and operator.

According to a still further feature in one described embodiment, the bottle holder further includes a locking pin manually movable parallel to its longitudinal axis to either a locking position locking the closure in its closed position, or to a releasing position releasing the closure for movement to its open position.

Further features and advantages of the invention will be apparent from the description below.

BRIEF DESCRIPTION OF THE DRAWINGS

FIG. 1 is a longitudinal sectional view illustrating one form of bottle holder constructed in accordance with the invention;

FIG. 2 is a sectional view along lines II—II of FIG. 1;

FIG. 3 is an enlarged fragmentary view illustrating the sealing arrangement in the holder of FIG. 1;

FIG. 4 illustrates a variation in the sealing arrangement;

FIG. 6 is a longitudinal sectional view illustrating the bottle holder of FIG. 5; and FIGS. 7 and 8 are enlarged fragmentary views illustrating the locking member in the bottle holder of FIGS. 5 and 6, FIG. 7 illustrating it in its releasing position, and FIG. 8 illustrating it in its locking position.

THE EMBODIMENTS OF FIGS. 1-3

Figure 5:
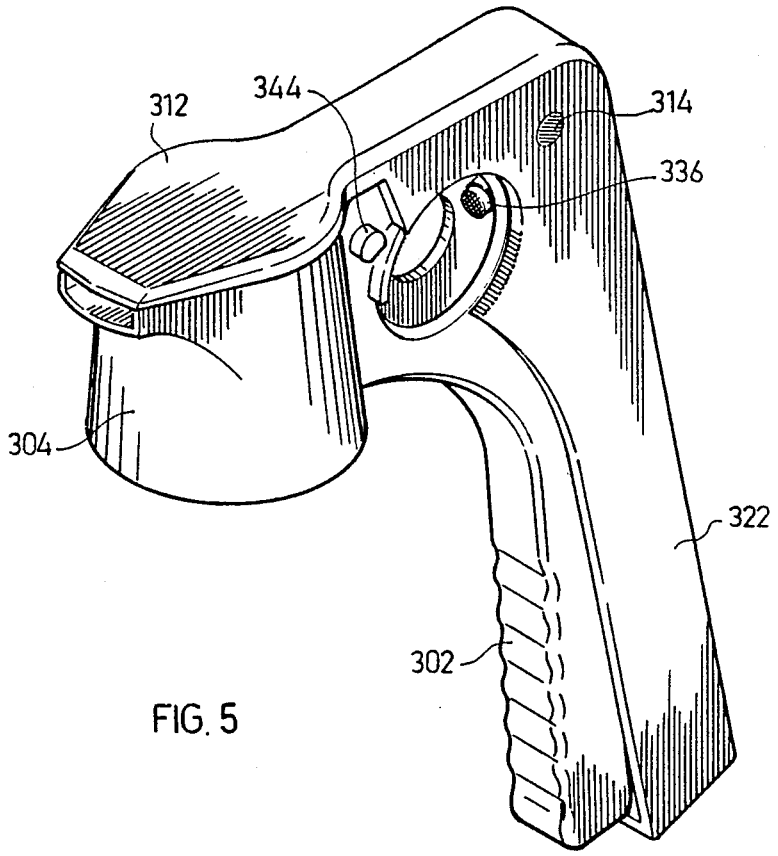
FIG. 5 is a perspective view illustrating another form of bottle holder constructed in accordance with the invention.

FIGS. 1-3 illustrate one form of bottle holder constructed in accordance with the invention. The bottle holder illustrated in FIGS. 1-3 includes a handle 202 graspable by the user, and an attachment member 204 fixed to one end of the handle and having internal threads 206 for threading onto the externally threaded neck of a bottle 208. The opposite end of attachment member 204 is open and is formed with a conical socket 210. A closure 212 is pivotally mounted by a pin 214 to attachment member 204, and is connected to an operator 222 which is operated by the user to move the closure to either its open position or its closed position with respect to the open end of the attachment member 204.

The operator 222 extends substantially parallel to the handle 202 and is pivotally mounted thereto about an axis, defined by pin 214, which is substantially perpendicular to but laterally of the longitudinal axis 215 of the bottle neck. As shown in FIG. 1, operator 222 complements the general outer configuration of handle 202 but is slightly longer than the handle, so that the handle can nest within the operator 222 when both the handle and the operator are squeezed towards each other by the user. The operator 222 is urged by a spring 224 to the position illustrated in FIG. 1, wherein the closure 212 is in its closed position, i.e., firmly seated within the bottle neck.

Handle 202 is formed, at an intermediate position thereof, with a circular cut-out 232 of a size slightly larger than the diameter of the conventional bottle cap. Cut-out 232 includes a radially-extending metal pin 234 aligned with another radially-extending metal pin 236 carried by the operator. Both pins serve as gripping surfaces which are engageable with the opposite sides of the bottle cap, when the handle and operator are squeezed together, to grip the cap and thereby to facilitate its removal by rotating the handle and operator about the axis 215 of the bottle neck.

Closure 212 carried by the operator 222 includes a stem 239 received within the neck of the bottle. A sealing ring 240 is applied to the outer surface of this stem so as to effect a seal between it and the inner face of the bottle neck when the stem is received therein.

As shown particularly in FIG. 3, sealing ring 240 is received within an annular groove 242 formed at the lower end of stem 239. In addition, the underface of sealing ring 240, namely the face facing the interior of the bottle when the closure stem 239 is inserted into the bottle neck, is formed with an annular recess 240*a*, which defines an outer flexible skirt 240*b* engageable with the inner face of the bottle neck. When the closure stem 239 is received within the bottle neck, and the interior of the bottle is pressurized (by the carbonizing gas therein), skirt 240*b* of the sealing ring 240 is deflected outwardly by the pressurized gas, thereby enhancing the seal between the closure stem 239 and the bottle neck.

As also shown in FIG. 3, the attachment member 204, attachable via its internal threads 206 to the external threads of the bottle neck, is formed with an annular shoulder 204*a* engageable with the outer tip of the bottle neck to limit the threading of the attachment member onto the bottle neck. The surface of attachment member 204 just underlying shoulder 204*a* is of conical configuration, as shown at 204*b*, to enhance the seal between the attachment member and the bottle neck.

The bottle holder illustrated in FIGS. 1–3 may be used in the following manner:

First, in order to remove the conventional bottle cap from the bottle, handle 202 and operator 222, both gripped by the user, are applied in a horizontal position over the bottle cap, with the cap received within the circular opening 232 formed in the handle. The handle and operator are then squeezed to cause the gripping pins 234 and 236, on opposite sides of this opening, to tightly engage the bottle cap, whereupon the handle and operator are rotated about the axis 215 of the bottle neck, to loosen and then remove the bottle cap.

After the bottle cap has thus been removed, the attachment member 204 is threaded around the bottle neck until the outer surface of the bottle neck engages annular shoulder 204*a* (FIG. 3) of the attachment member. During this procedure, operator 222 and handle 202 are squeezed together, so as to move the closure stem 239 away from the neck of the bottle; and when the bottle is firmly attached, the operator is released, whereupon spring 224 firmly moves the closure stem 239 into the bottle neck. In this closed position of the closure stem 239, a good seal is effected by sealing ring 240, this seal being enhanced by the pressure within the bottle which tends to deflect skirt 240*b* of the seal outwardly against the inner face of the bottle neck.

Whenever it is desired to dispense liquid from the bottle, handle 202 and operator 222 are grasped by the user and squeezed, whereupon the operator pivots about pin 214 to move the stem 239 of closure 212 out of the neck of the bottle, thereby permitting contents of the bottle to be dispensed while the bottle is conveniently held by handle 202 and operator 222. Release of the operator 222 will move the closure stem 239 back into the bottle neck by virtue of spring 224.

VARIATION OF FIG. 4

FIG. 4 illustrates a variation wherein the sealing ring, therein designated 340, is formed with a central membrane portion 340*c* receivable over the end of the stem 339, in addition to the annular recess 340*a* and flexible skirt 340*b* which is pressed against the inner face of the bottle received in the attachment member 304. In addition, the upper end of the sealing ring is of conical configuration as shown at 340*d*. These variations more positively assure a good seal between the cap stem 339 and the bottle.

THE EMBODIMENT OF FIGS. 5–8

FIGS. 5–8 illustrate another bottle holder basically of the same construction as illustrated in FIGS. 1-4, but including a locking member movable to either a locking position for locking the closure in its closed position, or to a releasing position releasing the closure for movement to its open position. Such a locking member thus better assures retaining the closure in its closed position without the need of a heavy spring for that purpose.

Thus, the bottle illustrated in FIGS. 5–8 includes a handle 302 and an attachment member 304 fixed to one end of the handle and having internal threads 306 for threading onto the externally-threaded neck of a bottle 308. The opposite end of attachment member 304 is open and is formed with a conical socket 310. A closure 312 is pivotally mounted by a pin 314 to attachment member 304, and is connected to an operator 322 which is operated by the user to move the closure to either its open position or its closed position with respect to the open end of the attachment member 304.

As in the embodiment of FIGS. 1–3, operator 322 extends substantially parallel to the handle 302 and is pivotally mounted thereto about a pivot axis, defined by pin 314, which is substantially perpendicular to but laterally of the longitudinal axis 315 of the bottle neck. Operator 322 is urged by a spring 324 to the position illustrated in FIG. 2, wherein the closure 312 is in its closed position, i.e., firmly seated within the bottle neck.

As also in FIGS. 1–3, a circular cut-out 322 is formed in handle 302 of a size slightly larger than the diameter of the conventional bottle cap, and includes a radially-extending metal pin 334 aligned with another radially-extending pin 336 carried by the operator 322, which pins serve as gripping surfaces for removing the bottle cap. Closure 312 carried by the operator 322 includes a stem 339 and a sealing ring 340, of the same structure as sealing ring 240 in FIGS. 1–3, effects a seal with the inner face of the bottle neck when the stem is received therein.

The bottle holder illustrated in FIGS. 5–8, insofar as described above, is of substantially the same construction and operates in substantially the same manner as described with respect to FIGS. 1–3.

However, the bottle holder illustrated in FIGS. 5–8 further includes a locking pin 344 carried by the attachment member 304 and cooperable with a stop 348 carried by the operator 322 for locking the operator, and thereby the closure 312, in the closed position of the closure. This is shown more particularly in FIGS. 7 and 8, wherein it will be seen that the portion of the attachment member 304 joined to the handle 302 is formed with a pair of spaced walls 304*a*, 304*b*, and that the locking pin 344 is formed with one end section 344*a* received within an opening formed in wall 304*a*, and with another end section 344b, received within an opening formed in wall 304b. Locking pin 344 is further formed with a slot 346 adjacent to its end section 344b. Slot 344b is normally (FIG. 7) aligned with stop 348, the stop being constituted of the tip of an extension 350 integrally formed with the operator 322 and extending between the two walls 304a, 304b of the attachment member 304.

Locking pin 344 is manually movable in the direction of its longitudinal axis, either to its releasing position as illustrated in FIG. 7, wherein its slot 346 is in alignment with stop 348, or to its locking position wherein its unslotted portion between the two walls 304a, 304b is in alignment with stop 348. When in its locking position, locking pin 344 prevents the stop 348 from being pivoted about the pivotal axis (pin 314) of operator 322, and thereby locks the operator, together with the closure 312 carried thereby, in the closing position of the closure as illustrated in FIG. 6. The two end sections 344a, 344b of locking pin 344 are of non-circular cross-section, and the openings in the respective walls 304a, 304b are of complementary non-circular cross-section, so as to prevent the locking pin from being rotated about its longitudinal axis, but to permit it to be moved axially along its longitudinal axis to either of the two positions illustrated in FIGS. 7 and 8.

The bottle holder illustrated in FIGS. 5–8 is used in the same manner as described above with respect to pour to FIGS. 1–3. Thus, whenever the user wishes out contents from the bottle held by the holder, operator 322 is squeezed towards handle 302, thereby pivoting closure 312 about pivot pin 314 (clockwise, FIG. 9) to move the closure 312, and its stem 339 and seal 340, out of the mouth of the bottle held by the holder. In this normal use of the bottle holder to pour out contents from the bottle, locking pin 344 would be in the position illustrated in FIG. 7, namely with its slot 346 in alignment with stop 348, thereby permitting the operator 322 to be pivoted to the open position of closure 312.

At all other times, locking pin 344 would be pushed inwardly, to the position illustrated in FIG. 8, whereupon its middle, unslotted, section comes into alignment with stop 348. In this position, the locking member blocks the pivotal movement of stop 348, and thereby locks the operator 322, and therefore also closure 312, about pivot pin 314. This in turn locks the closure 312 in its closed position wherein its stem 339 and seal 340 are firmly retained within the neck of the bottle. This locking arrangement in the embodiment of FIGS. 5–8 therefore more positively assures sealing of the bottle held by the holder without using a heavy spring for this purpose.

While the invention has been described with respect to two preferred embodiments, it will be appreciated that many other variations, modifications and applications of the invention may be made.

What is claimed is:

1. A bottle holder for a bottle having a neck formed with external threads for receiving a cap, said bottle holder comprising:

a handle manually graspable by a user;

an attachment member fixed to one end of the handle, said attachment member having internal threads at one end for threading into the external threads of the neck of the bottle and being open at the opposite end;

a closure movably mounted to said attachment member either to a closed position closing said open end of the attachment member, or to an open position with respect thereto;

an operator pivotally mounted to the handle;

said operator being fixed to said closure on one side of the pivotal mounting of the operator to the handle to enable the operator, when squeezed towards the handle, to pivot said closure to either its open position or to its closed position with respect to the open end of said attachment member;

said closure including a stem carrying a sealing ring receivable within the neck of the bottle in the closed position of the closure;

spring means interposed between said handle and operator and normally urging the operator to the closed position of the closure; and a cap remover having a gripping surface formed at an intermediate location on the handle and a gripping surface formed at a corresponding location on the operator, said gripping surfaces being located to engage and grip the opposite sides of the cap, when the operator is operated by the user, and thereby to facilitate removal of the cap by rotating the handle about the axis of the bottle neck.

2. The bottle holder according to claim 1, wherein said stem is formed with an annular groove receiving said sealing ring, and the face of said sealing ring disposed inwardly of the bottle neck is formed with an annular recess defining an outer annular skirt deflectable outwardly by the pressure within the bottle to enhance the sealing effecting by said sealing ring.

3. The bottle holder according to claim 1, wherein said attachment member is formed with an outer conical surface bordering an annular shoulder both engageable with the outer tip of the bottle neck when the attachment member is attached thereto.

4. The bottle holder according to claim 1, wherein said gripping surfaces in the handle and operator are defined by pins fixed to said handle and operator.

5. The bottle holder according to claim 1, further including a locking member movable either to a locking position locking said closure in its closed position, or to a releasing position releasing said closure for movement to its open position.

6. A bottle holder for a bottle having a neck formed with external threads for receiving a cap, said bottle holder comprising:

a handle manually graspable by a user;

an attachment member fixed to one end of the handle, said attachment member having internal threads at one end for threading into the external threads of the neck of the bottle, and being open at the opposite end;

a closure movably mounted to said attachment member either to a closed position closing said open end of the attachment member, or to an open position with respect thereto;

an operator extending substantially parallel to the handle and pivotally mounted thereto about an axis substantially perpendicular to but laterally of the axis of the bottle neck;

said operator being mechanically connected to said closure to enable the operator, when squeezed towards the handle by the user, to move said closure to either its open position or to its closed position with respect to the open end of said attachment member;

and spring means interposed between said handle and operator and normally urging the operator to the closed position of the closure;

an intermediate portion of the handle including a gripping surface engageable with one side of the cap, and an intermediate portion of said operator also including a gripping surface engageable with the opposite side of the cap when the operator is operated by the user, to grip the cap and thereby to facilitate its removal by rotating the handle about the axis of the bottle neck.

7. The bottle holder according to claim 6, wherein said closure is pivotally mounted to said attachment member to either the closed position of the closure closing the bottle neck, or to its open position spaced outwardly of the neck of the bottle.

8. The bottle holder according to claim 7, wherein said closure includes a stem carrying a sealing ring receivable within the neck of the bottle in the closed position of the closure.

9. The bottle holder according to claim 8, wherein said stem is formed with an annular groove receiving said sealing ring, the face of said sealing ring disposed inwardly of the bottle neck being formed with an annular recess defining an outer annular skirt deflectable outwardly by the pressure within the bottle to enhance the sealing effected by said sealing ring.

10. The bottle holder according to claim 9, wherein said gripping surfaces in the handle and operator are defined by pins fixed to said handle and operator, respectively.

11. The bottle holder according to claim 6, further including a locking member movable to either a locking position locking said closure in its closed position, or to a releasing position releasing said closure for movement to its open position.

12. A bottle holder for a bottle having a neck formed with external threads for receiving a cap, said bottle holder comprising:

a handle manually graspable by a user;

an attachment member fixed to one end of the handle, said attachment member having internal threads at one end for threading onto the external threads of the neck of the bottle, and being open at the opposite end;

a closure movably mounted to said attachment member either to a closed position closing said open end of the attachment member, or to an open position with respect thereto; and an operator carried by said handle and mechanically coupled to said closure to enable the operator, when operated by the user, to move said closure to either its open position or to its closed position with respect to the open end of said attachment member;

and a locking pin manually movable parallel to its longitudinal axis either to a locking position locking said closure in its closed position, or to a releasing position releasing said closure for movement to its open position.

13. The bottle holder according to claim 12, wherein said locking pin is carried by said attachment member and is cooperable with a stop fixed to said operator, said locking pin including a shoulder located so as to be in alignment with said stop in the locking position of the locking pin to prevent pivoting said operator and said closure therewith, but to be out of alignment with said stop in the releasing position of the locking pin to permit pivoting said operator and said closure therewith.

14. The bottle holder according to claim 13, wherein said closure is pivotally mounted to said attachment member, said locking pin being located between the attachment member and the pivotal mounting of the closure to said attachment member, with the longitudinal axis of the locking pin extending parallel to said pivotal axis.

15. The bottle holder according to claim 14, wherein said stop is constituted of the tip of an extension integrally formed on the operator and located on one side of the locking pin in alignment with said slot in the locking pin in the releasing position of said locking pin.

16. The bottle holder according to claim 12, wherein said locking pin includes a non-circular section movable in a complementary non-circular opening formed in said attachment member to prevent the rotation of the locking pin about its longitudinal axis.

17. The bottle holder according to claim 13, wherein the portion of said attachment member receiving said locking pin is formed with a pair of spaced walls, said stop being carried by said operator between the spaced walls of said attachment member.

* * * * *